United States Patent [19]

Zelina, Jr.

[11] 4,309,745

[45] Jan. 5, 1982

[54] REFLECTOR

[76] Inventor: John H. Zelina, Jr., 480 Manchester Rd., Fairview, Pa. 16415

[21] Appl. No.: 146,096

[22] Filed: May 2, 1980

Related U.S. Application Data

[63] Continuation of Ser. No. 973,522, Dec. 26, 1978, abandoned.

[51] Int. Cl.[3] ..... F21L 7/00

[52] U.S. Cl. ..... 362/186; 362/200; 362/221; 362/222; 362/223; 362/260

[58] Field of Search ..... 362/186, 200, 221, 222, 362/223, 260

[56] References Cited

U.S. PATENT DOCUMENTS 4,268,894 5/1981 Bartunck ..... 362/186 X

*Primary Examiner*—Stephen J. Lechert, Jr.

[57] ABSTRACT

A light reflector for a light is disclosed which may be formed by progressive dies to form all electrical contacts from a coil or sheet of the electrically conductive metal. After formation of the contacts and buss work the last stage of the progressive die automatically inserts the buss work on the plastic reflector which is secured by tinnerman type locks formed by the progressive die or by heat staking. The reflector supports a printed circuit card which contains the circuit and switching means. The end result is the elimination of any wiring from the PC Card to the battery and fluorescent tube contacts. The angular mounds direct any misaligned battery contacts to the proper contact area. Trusses formed on their reflector are aligned to support the battery pick-up contacts to avoid contact deflection, and assure proper contact orientation. The switch protrudes from a preformed window in the lantern case after assembly.

17 Claims, 10 Drawing Figures

REFLECTOR

This is a continuation, of application Ser. No. 973,522 filed Dec. 26, 1978 now abandoned.

GENERAL DESCRIPTION OF THE INVENTION

The light reflector assembly disclosed herein is provided to minimize labor by utilizing automatic progressive dies to form all electrical contact and buss work from a coil or sheet of electrically conductive metal with or without corrosive resistant plating.

After formation of the contact and the buss work the last stage of the progressive die automatically inserts (by means of mechanical transfer) these formations onto a plastic reflector. The reflector has posts which accept the contacts and buss work. The contact and buss work are, in turn, secured to the reflector by means of "tinnerman" type locks already formed on the metals by progressive dies. These can also be accomplished by heat staking or heat heading the posts.

The injection molded reflector also contains support to hold a printed circuit card which contains the circuit and switching means. The end result is the elimination of any wiring from the PC Card to the battery and fluorescent tube contacts. These connections are constructed by the method mentioned above, placed so as to make contact with the proper terminal areas. The plastic plate has mounds which have the function of directing any misaligned battery contacts to the proper contact area. Trusses from the reflector are aligned to support the battery pick-up contacts to avoid contact deflection and arrangement of the battery pick-up contacts enable standard (coil type contact) 6 volt lantern batteries to be inserted in any manner of contact orientation while assuring proper battery voltage polarity to the ballast on the PC board.

The switch is aligned on the PC Card in such a manner that it protrudes through a preformed window in the lantern case after assembly. Since the negative contact on the battery is common to one end of the fluorescent tube in the circuit, the connection can be made by means of an extention of the B-contact plate into the appropriate fluorescent tube holder.

OBJECTS OF THE INVENTION

It is an object of the invention to provide an improved fluorescent light reflector.

Another object of the invention is to provide an improved assembly of contact and fluorescent lamp reflector with printed circuit card that can be formed by a continuous progressive die.

Another object of the invention is to provide an improved combination battery and terminal connections and printed circuit card and reflector.

Another object of the invention is to provide a reflector and circuit arrangement for a battery operated light, that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
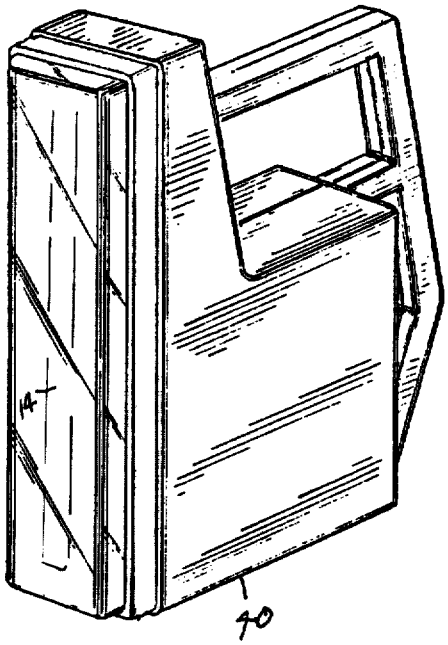
FIG. 1 is an isometric view of the light according to the invention.
Figure 2:
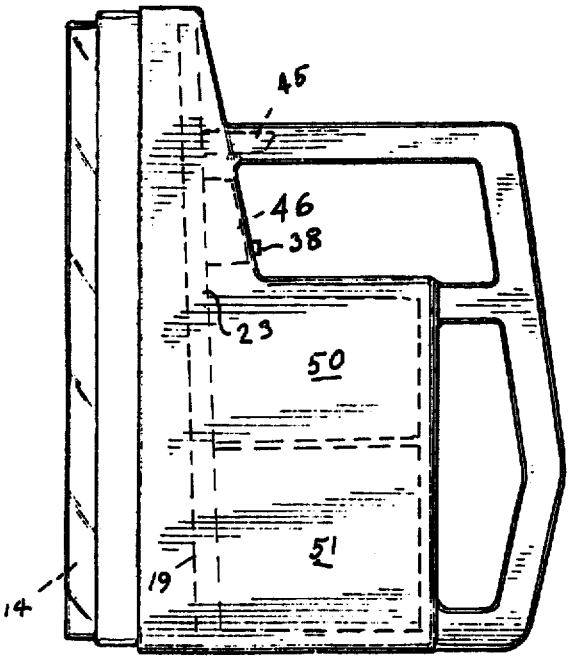
FIG. 2 is a side view of the light shown in FIG. 1.
Figures 3, 4, 5, 6:
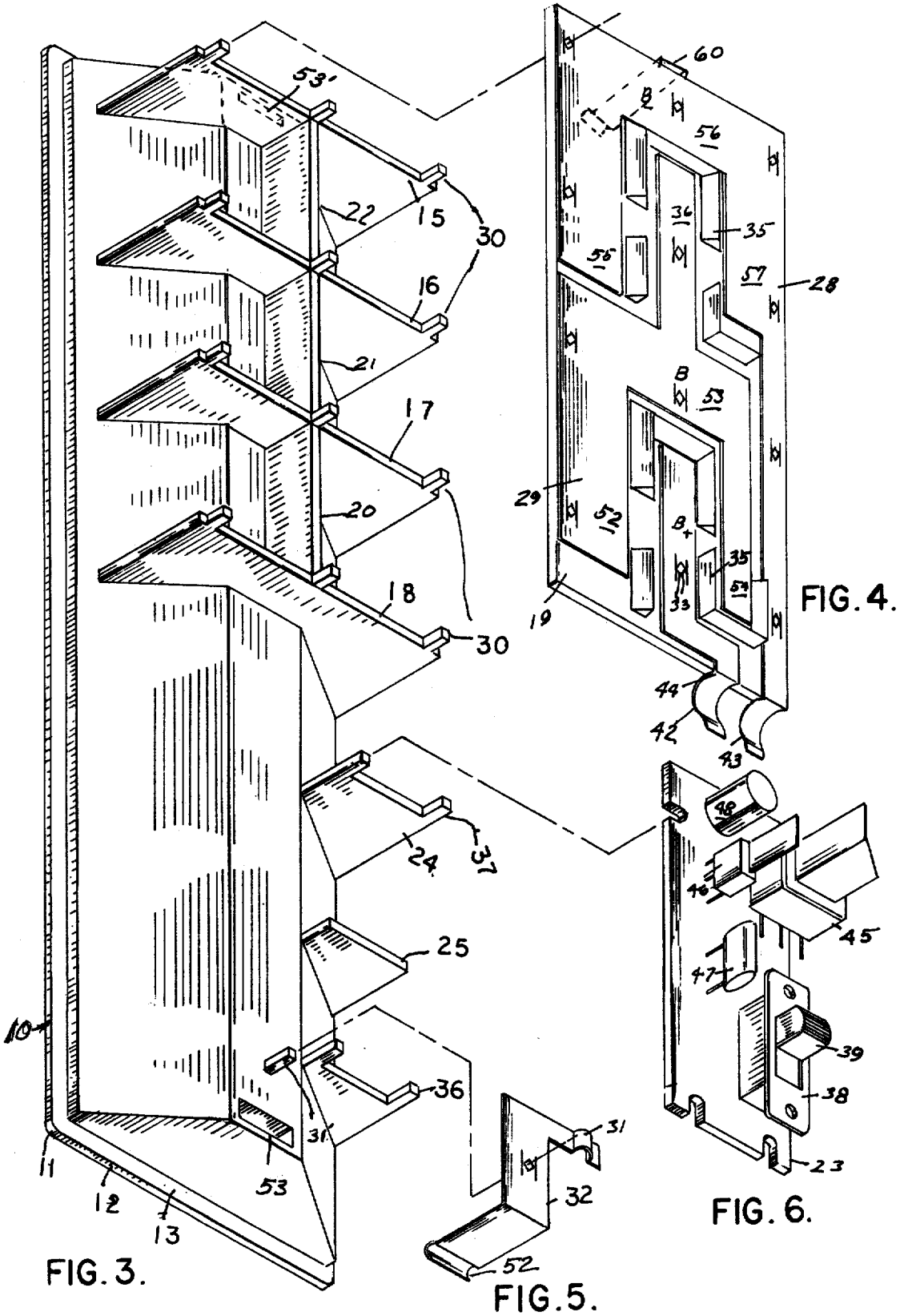
FIG. 3 is a rear isometric view of the reflector.
FIG. 4 is an assembly of the terminal support board and first contact plate and second contact plate, and third contact plate.
FIG. 5 is an isometric view of the high voltage contact.
FIG. 6 is an isometric view of the printed circuit card.
Figures 7, 8, 9, 10:
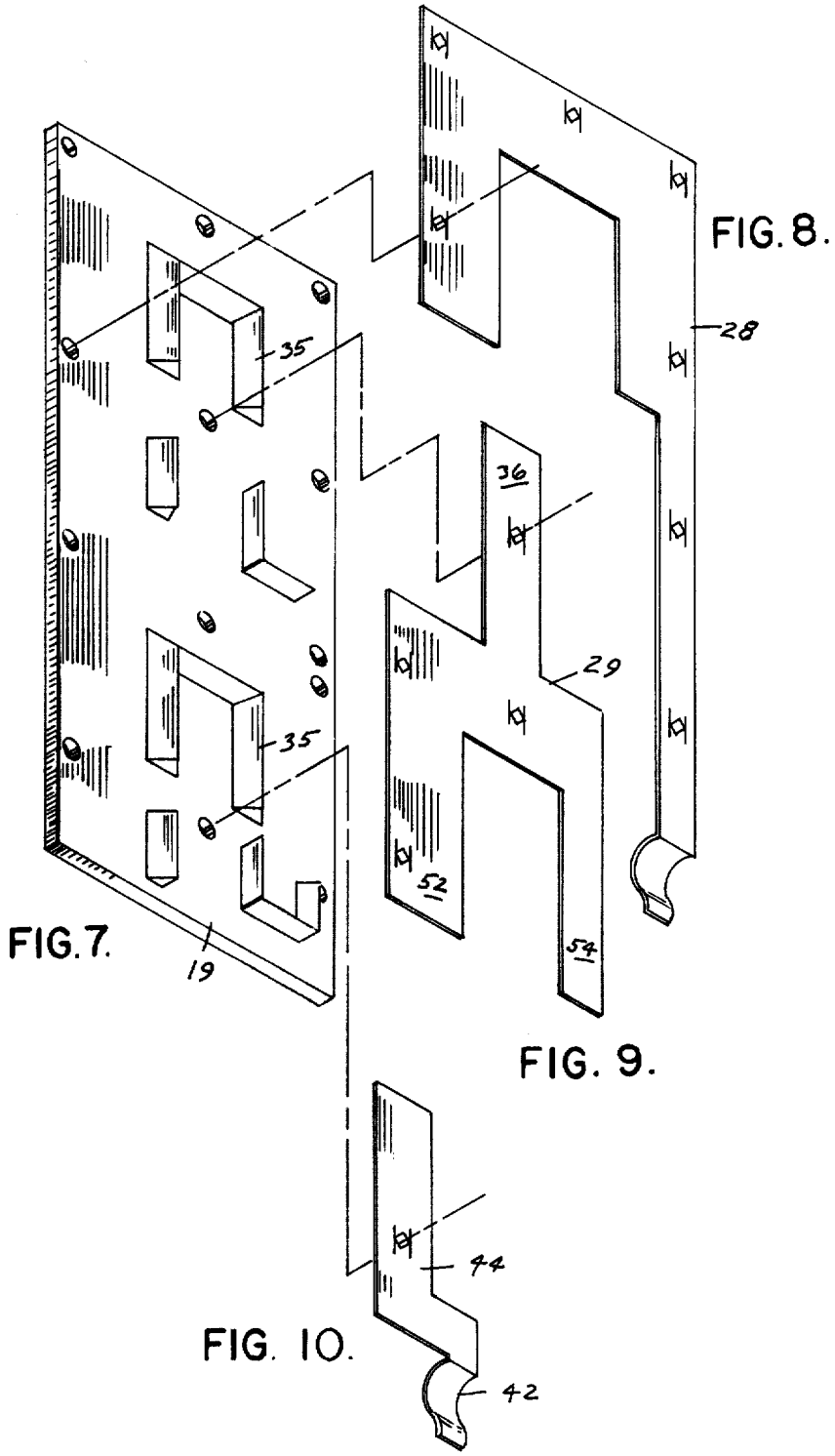
FIG. 7 is a view of the terminal support board.
FIG. 8 is a view of the first battery pick-up plate.
FIG. 9 is a view of the second battery pick-up plate.
FIG. 10 is a view of the third battery pick-up plate.

Now, with more particular reference to the drawings, a reflector assembly 10 and contact assembly is shown made up of a reflector 11, the reflector has a concave reflecting first side 12 and second side 13. The lamp 14 is supported on the first side. The reflector has a plurality of the first trusses 15, 16, 17 and 18 and second on a side in the contact plate 19 is supported on the trusses. The trusses 15, 16, 17 and 18 have posts 30 which extend through openings in the support plate 19 and through the Tinnerman fasteners on the first terminal plate 28 and second terminal plate 29 and third terminal plate 44. The second trusses 24 and 26 have posts 36 and 37 that are received in openings in the printed circuit card 23. The printed circuit card 23 has a switch 38 with an actuating member 39 which extends out through a window in the case 40 of the light. The first terminal plate 28, the second terminal plate 29 and the third terminal plate 44 form contacts for the battery. The battery is guided into position by the mounds 35 on the support plate.

The high voltage contact 32 has a contact member 31 that engages the elements on the bottom of the printed circuit card 23. The terminals 43 and 42 on the contact plate 28 and on the contact member 44 engages terminals on the circuit card 23. When the contact plate 19 is supported on the trusses 15, 16, 17 and 18 with the posts 30 extending through the opening therein and up through the Tinnerman fasteners on the first, second and third terminal plates, these elements are held in position. A post 31' holds the high voltage contact 32 on the reflector 11. The battery terminals are guided onto them by mounds 35 on the support plate 19. The printed circuit card has the switch 38 and an electronic element 45, and 46 to supply energy to 47 and 48. The light has two batteries 50 and 51 that are received in the lamp case. Each has a center terminal B+ and a side terminal B−. The center terminal on battery 50 engages contact 44 while the side terminal engages the one of the legs 52, 53 or 54 on contact plate 29. The center terminal on battery 51 engages leg 36 on plate 28, while the side terminal on battery 50 engages one of the legs 55, 56 or 57 on plate 28, thereby connecting the batteries in series with each other. The terminal ends 42 and 43 engage terminals on the PC board, connecting battery positive terminal and battery minus to the printed circuit board 23. Terminal 60 extends through a hole in reflector 10 like hole 53 and engages a terminal on the end of lamp 14 opposite terminal 52.

The embodiments of the invention in which an exclusive property or privilege is claimed are defined as follows:

1. A reflector assembly and contact assembly (10) comprising a reflector (11), said reflector having a concave reflectory surface on a first side (12) and a second side (13), means supporting a lamp (14) on said first side (12), a plurality of longitudinally spaced first trusses (15, 16, 17 and 18) on said second side (13), a contact support plate (19), means on the outer ends of said first trusses (15, 16, 17 and 18) supporting said contact support plate (19) on said reflector, a plurality of second brackets (20, 21 and 22) on said second side, a printed circuit board (23), support means comprising second support trusses (24, 25 and 26), supporting said printed circuit board 23 generally in a plane parallel to said contact plate, a first terminal plate (28), a second terminal plate (29) and a third terminal plate (44), means (30), supporting said first terminal plate on said contact support plate (19), a second terminal plate (29), means supporting said second terminal plate (29) on said contact plate (19) in a plane generally parallel thereto, contact means (44) on said contact plate (19) engaging a terminal on side printed circuit board (23), said first terminal plate (28) having means to engage a second contact on said printed circuit board (23), whereby power from a battery means may be connected from said terminal plates to said printed circuit board (23).

2. The reflector assembly recited in claim 1 wherein a high voltage contact (32) for connecting said PC board to a said lamp is provided and means on said reflector (11) supporting said high voltage reflector contact (32).

3. The assembly recited in claim 1 wherein said contact plate comprises, a flat plate-like member having spaced holes therein and said trusses have posts on the upper ends thereon extending through said holes in said contact support plate.

4. The assembly recited in claim 3 wherein said first terminal plate comprises, a flat plate-like member having spaced holes therein and some of said posts on said first trusses extend through said holes in said first terminal plate (28).

5. The assembly recited in claim 4 wherein said second terminal plate has spaced openings therein and some of said posts on said first trusses extends through said openings in said second terminal plates.

6. The assembly recited in claim 5 wherein said first terminal plate and said second terminal plate have means thereon engaging said posts, holding said terminal plates in position.

7. The assembly recited in claim 6 wherein said contact support plate has a recess (35) therein and said second terminal plate has an elongated extension member thereon extending into said recess.

8. The assembly recited in claim 7 wherein said contact support plate has a recess therein, a third terminal plate has an opening receiving a post (30) on said reflector whereby said third terminal is held in position.

9. The assembly recited in claim 8 wherein said first terminal plate (28) has an extension thereon extending out beyond the end of said support plate and having means thereon to engage a terminal of a PC card.

10. The assembly recited in claim 9 wherein said first terminal plate has a tab for engaging a terminal on said lamp.

11. The assembly recited in claim 9 wherein said reflector has a second truss members (24, 25 and 26) thereon and said printed circuit board supported on said second truss member.

12. The assembly recited in claim 11 wherein said printed circuit board has means thereon engaging said terminals on said first contact plate and said third contact plate.

13. The assembly recited in claim 12 wherein said printed circuit board has means thereon engaging said terminals on said first contact plate and said third contact plate.

14. The assembly recited in claim 13 wherein said printed circuit board has a switch (38) thereon, said switch having actuating means extending through an opening in said case of a said light.

15. The assembly recited in claim 14 wherein said high voltage terminal extends from an opening in said reflector to engage a fluorescent light supported in said reflector.

16. A light, said light having a case having closed sides and an open front, a reflector supported in said open front, said reflector having a terminal plate supported on the back side thereof, means supporting a first contact plate and a second contact plate, and a third contact plate, on said reflector, at least two batteries in said case, said first contact plate, said second contact plate and said third contact plate being adapted to engage the terminals of said batteries, a printed circuit board supported on said reflector in a plane generally parallel to the plane of said contact plate, said terminals on said first and said third plates being adapted to engage contacts on said printed circuit board, a high voltage terminal supported on said reflector, means on said high voltage terminal engaging a contact on said printed circuit board and said high voltage terminal extending from an opening in said reflector to engage a first terminal and fluorescent tube therein, and means on said first terminal plate engages a second terminal a fluorescent tube.

17. A light, said light having a case having closed sides and an open front, a reflector supported in said open front, a lens support over said reflector, said reflector having a terminal plate supported on the back side thereof, means supporting a first contact plate and a second contact plate on said reflector, a battery in said case, said first contact plate and said second contact plate being adapted to engage the terminals of said batteries, a printed circuit board supported on said reflector in a plane generally parallel to the plane of said contact plate, said terminals on said first and said second plates being adapted to engage contacts on said printed circuit board, a high voltage terminal supported on said reflector, means on said high voltage terminal engaging a contact on said printed circuit board and said high voltage terminal extending from an opening in said reflector to engage a first terminal and fluorescent tube therein, and means on said first terminal plate engages a second terminal a fluorescent tube.

* * * * *